United States Patent [19]

Parker et al.

[11] 4,367,623

[45] Jan. 11, 1983

[54] PIECING UP A FRICTION SPINNING APPARATUS

[76] Inventors: Alan Parker, 7 Darvel Close, Breightmet, Bolton, Lancashire; Peter J. Dickinson, 30 Narcissus Ave., Helmshore, Rossendale, Lancashire; Douglas O. Clough, 26 Parkwood Dr., Rawtenstall, Rossendale, Lancashire; William M. Farnhill, 335 Colne Rd., Burnley, Lancashire, all of England

[21] Appl. No.: 235,332

[22] Filed: Feb. 17, 1981

[30] Foreign Application Priority Data

Feb. 16, 1980 [GB] United Kingdom ..... 8005322

[51] Int. Cl.[3] ..... D01H 15/02

[52] U.S. Cl. ..... 57/263; 57/401

[58] Field of Search ..... 57/261, 263, 58.89–58.95, 57/327, 401

[56] References Cited

U.S. PATENT DOCUMENTS

| | | | |
|---|---|---|---|
| 3,635,006 | 1/1972 | Fehrer | 57/58.89 |
| 3,972,173 | 8/1976 | Fehrer | 57/58.89 |
| 4,168,601 | 9/1979 | Didek et al. | 57/58.95 |
| 4,202,163 | 5/1980 | Turk et al. | 57/58.95 |
| 4,222,222 | 9/1980 | Didek et al. | 57/58.89 X |
| 4,315,398 | 2/1982 | Parker et al. | 57/58.89 X |

*Primary Examiner*—John Petrakes

*Attorney, Agent, or Firm*—Donald H. Feldman

[57] ABSTRACT

Spinning is started on a friction spinning apparatus by drawing the end of yarn back to a position adjacent the surface but in such a condition that it is free from the influence of the suction through the surface. This is done by closing off the suction while the end is in the position so that the yarn is drawn by an additional suction source into an adjacent position. The yarn end is drawn from one end of the surface to lie along the surface by gradually closing off the suction from that end toward the opposite end. Subsequently the suction is reopened to bring the yarn end under its influence to draw the end onto the surface so the fibre feed and take-up can be restarted.

21 Claims, 4 Drawing Figures

PIECING UP A FRICTION SPINNING APPARATUS

FIELD OF THE INVENTION

This invention relates to apparatus and method of open-end spinning yarn. More particularly it relates to an apparatus of the kind generally known as a friction spinning apparatus including at least one surface, means for feeding fibres onto the surface at a yarn formation area, means for applying suction through the surface at the yarn formation area, means for moving the surface past the yarn formation area to twist the fibres deposited thereon to form a yarn, means for withdrawing the yarn transversely to the direction of motion of the surface and means for packaging the withdrawn yarn.

BACKGROUND OF THE INVENTION

One problem which must be considered before a commercial machine can be released is the provision of a technique for piecing up the yarn to start spinning after an end break.

This problem has been considered by Vyzkumny Ustav Bavlnarsky of Czechoslovakia in their British Pat. No. 2 011 956 and in their U.S. Pat. No. 4 168 601. In both of these patents the yarn is drawn back mechanically by a drawing-in hook moved by the operator and clamped beyond the end of the twisting surfaces. During the movement of the yarn it is under the influence of the suction through one of the surfaces and hence is drawn onto the surfaces.

The problem has also been considered briefly by Dr. Fehrer in his early U.S. Pat. No. 3 635 006. In this technique a seed yarn is drawn back presumably by a drawing-in hook beyond the end of the twisting surfaces into the fibre feed tube. The device shown in this patent has not met with any technical success and has been superceded.

In Japanese patent No. 51-1733 of Toyoda, they propose a technique wherein the yarn end is drawn back presumably mechanically onto a twisting belt with the suction on so that the yarn is drawn into contact with the belt.

Whilst these techniques may be satisfactory in a research environment where only one or a few spinning positions are to be pieced-up, none of them is considered satisfactory for a machine to be sold commercially.

SUMMARY OF THE INVENTION

It is an object of this invention to provide a simple, quick method for starting spinning an apparatus of this kind which will be fully satisfactory in a commercial machine having many spinning positions.

Accordingly the invention provides firstly a method comprising taking back the yarn from the package and withdrawing it such that the end portion of the yarn extends to a predetermined length; moving the end portion to a position such that it lies adjacent the yarn formation area and in such a condition that it is free from the influence of the suction; bringing the end portion under the influence of the suction such that it is drawn to lie on the yarn formation area; restarting the fibre feed means; and restarting the withdrawal of the yarn from the yarn formation area.

Additionally the invention provides an apparatus of this kind characterized in that it includes means for moving an end portion of yarn withdrawn from the package to a position such that it lies adjacent the yarn formation area and in a condition such that it is free from the influence of the suction means, and means for bringing the end portion under the influence of the suction means such that it is drawn to lie on the yarn formation area.

Furthermore, the invention provides means for gradually closing off the suction through the surface from one end of the yarn formation area toward the opposite end whereby to move the yarn toward the opposite end.

DESCRIPTION OF THE PREFERRED EMBODIMENT.

Figure 2:
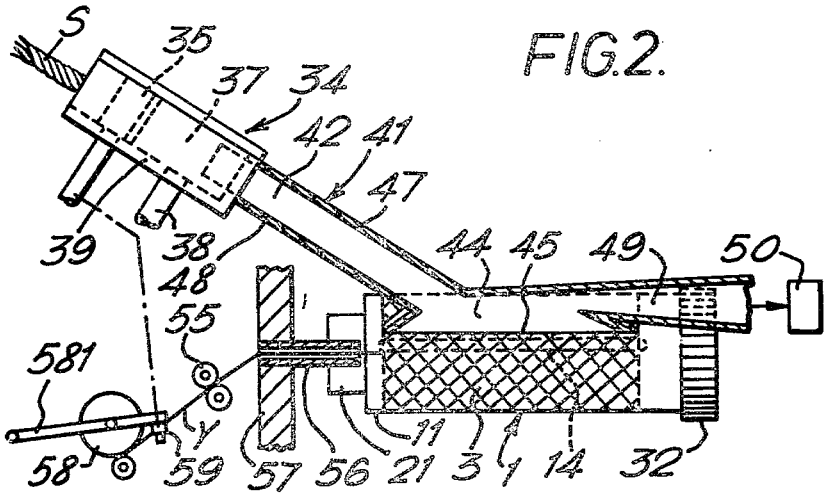
FIG. 2 is a section along the line II—II in FIG. 1.

The apparatus is basically as described in our published British application No. 7936653 (corresponding to U.S. Ser. No. 88262) and most of the following description of the general operation of the apparatus is taken therefrom. The apparatus comprises a pair of parallel, closely spaced drums 1 and 2. The surface of the drum 1 includes a portion which is perforated as shown at the area 3, which is cross-hatched in FIG. 2. The drum 2 is imperforate and formed of a metal core cylinder 4 on which is bonded a cylindrical shell or coating 5 of a resilient material. The peripheral surfaces of the drums 1, 2 define between them a gap which tapers towards a narrow throat at the point of closest approach.

The cylinder 4 of the roller 2 is carried upon ball bearings 6 for free rotation about a shaft 7 which supports the bearings 6. The shaft itself is rigidly supported in respective bores in a pair of arms 8, 9 which are pivotally mounted such that the arms 8, 9 and thence the roller 2 can be pivoted to increase or decrease the gap between the rollers 1 and 2.

The roller 1 comprises the perforated cylindrical portion 3 and imperforate extensions 11 and 12 which act to give support and rigidity to the portion 3. Within the roller 1 is mounted a suction tube 13 which comprises an elongate cylinder forming a tight clearance, of the order of 1 or 2 thousands of an inch, with the roller such that the roller is free to rotate about the tube 13. The tube 13 includes a slot 14 (shown in dotted line in FIGS. 2 and 4) adjacent the throat between the rollers 1 and 2 to communicate suction within the tube 13 to the throat as will be explained hereinafter.

The tube 13 is rigidly mounted at one end by insertion within a bore 14 formed in a support 15 fixed to a machine frame 16 against which the end of the tube 13 abuts. The bore 14 is opened out to form a cylindrical cavity 17 so as to provide a housing for a bearing 18 which rotatably supports one end of the perforated drum 1.

Figure 4:
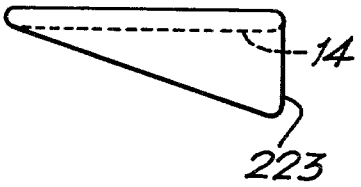
FIG. 4 is a part section along the line IV—IV in FIG. 1 showing on shape of the slot 223 of the nozzle 222.

The other end of the tube 13 is closed and reduced in cross-section to provide a boss 19 on which is supported a bearing 20 for rotatably supporting a reduced diameter portion 21 at the end of the drum 1. The interior of the tube 13 communicates with a source of suction 22 which comprises a duct extending through the machine frame 16 to a position adjacent the perforated portion 3, terminating in an end collar 221. A nozzle 222 provides a circular opening in direct communication with the duct 22 at the collar 221 and tapers to provide a slot 223 normally in direct communication with the slot 14 of the tube 13. The shape of the slot 223, shown in FIG. 4, is substantially triangular with one side coextensive with the slot 14 and the other side extending beyond the slot 14 to form a triangular extension position. The purpose of this shape will be described hereinafter.

The drive for the drums 1 and 2 is derived from a motor, drive couplings and timing belts (not shown) which communicate drive via pulleys 28 and 32 such that their respective belts drive the drums 1, 2 in the same direction, i.e. in an anti-clockwise direction as seen from the right. The rotation of the drums 1 and 2 is such that the periphery of drum 2 provided with the coating 5 moves out of the throat towards the side adjacent to the fibre feed duct 41 and the peripheral surface of the drum 1 provided with the perforated portion 3 moves from the side adjacent the fibre feed duct 41 into the throat.

A fibre feed apparatus, generally indicated at 34, comprises a sliver feed roller 35, a feed pedal (not shown), and a beater 37 mounted on a shaft 38 for rotation within a housing 39. This type of fibre feed apparatus 34 is well-known in open-end spinning systems of the spinning rotor type and an example is described in more detail in British Pat. No. 1 368 886.

The fibres are conveyed from the fibre feed apparatus 34 to the throat formed between the peripheral surfaces of the drums 1, 2 by a fibre feed duct 41. The fibre feed duct 41 has a first duct portion 42 having a fibre inlet aperture in communication with a rectangular passage provided in the housing and a second terminal duct portion or nozzle 44 which terminates in an elongate mount 45 within the throat. The first duct portion 42 is of varying rectangular cross-section defined by two side walls 46, which gradually converge as the first duct portion 42 approaches the throat, and by a front wall 47 and a rear wall 48. The longitudinal axis of the first duct portion 17 is inclined at an angle of 20° to 45° and more preferably 25° to 30° with respect to the axis of the drums 1, 2.

At the junction of the first and second duct portions 42, 44 the front wall 47 terminates in an air channel or duct 49 which communicates with the terminal duct portion 44. The duct 49 extends from the terminal duct portion 44 in a direction generally parallel to the axes of the drums 1, 2 and is connected to a source of suction indicated schematically at 50.

In operation, a sliver 'S' is forwarded between the nip formed between the feed roller 35 and the feed pedal 36 to an opening and combing action effected by needles or teeth on the peripheral surface of the beater 37. The opened fibres are conveyed on the peripheral surface of the beater 37 to the entrance of the fibre feed duct 41 where they are removed from the beater 37. In the duct 41 the fibres are entrained in an airstream derived from the source of suction connected to the interior of the tube 13 by the duct 22. This source of suction communicates with the passage 43 through the nozzle 222, the slot 14, the perforated portion 3 and the mouth 45. After passing through the duct 41 the fibres are conveyed by the airstream into the throat, which forms a yarn formation zone in which the fibres are twisted by rotation of the drums 1, 2 into a yarn 'Y'. The yarn is then withdrawn axially of the drums 1, 2 along the throat and through a delivery tube 56 mounted in the frame wall 57 by a pair of delivery rollers 55, located on the opposite side of the fibre feed duct 41 to that of the suction duct 49, and wound into a package 58. The package is mounted on pivotally mounted package arms 581 so as to be manually movable onto and away from a driving roller, and one of the arms 60 carries a manually operable switch 59 for starting the feed roller 35 under the control of the operator.

Figure 1:
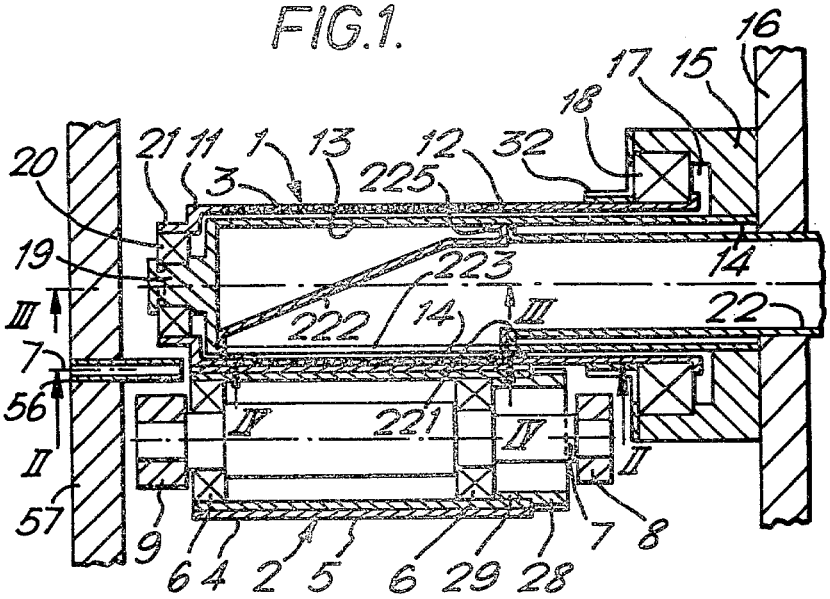
FIG. 1 is a sectional plan view of an open-end spinning apparatus according to the invention, with for simplicity part of the operating mechanism omitted.
Figure 3:
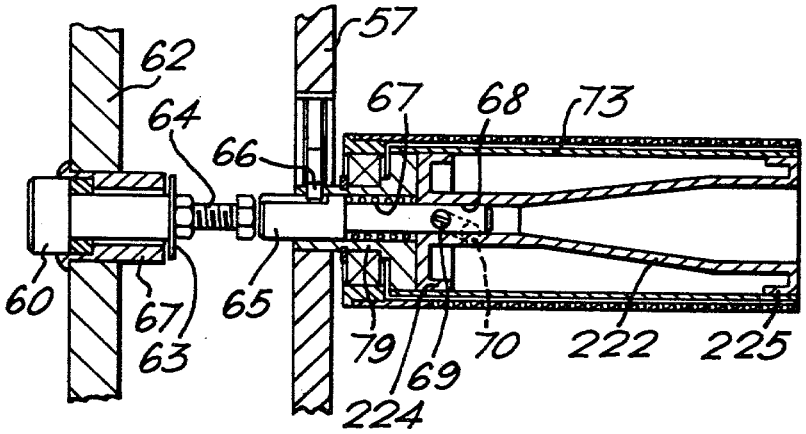
FIG. 3 is a part section along the line III—III in FIG. 1, showing in detail the operating mechanism omitted from FIG. 1.

Turning now to FIG. 3, there is shown a device, not illustrated in FIG. 1, for turning the nozzle so that the slot 223 is moved out of registry with the slot 14. Specifically, the device comprises a manually operable button 60 which is slidable in a bush 61 mounted on a frame piece 62. The button 60 is held in the bush by a washer and nut 63. A shaft 64 is connected to the button 61 to co-operate with a further shaft 65 so that both are moved along their length upon depression of the button 60. The shaft 65 is keyed against rotation by a portion 66 of the frame piece 57 and passes through a bore 67 of the end piece 19 of the tube 13 into a bore 68 of the nozzle 222.

The nozzle 222 of plastics material includes collers 224, 225 at its ends, the collar 225 co-acting with collar 221 (FIG. 1) and the collar 224 co-acting with the end portion 19, to allow rotation of the nozzle within the tube 13 but to prevent axial movement. The walls defining the slot 223 (FIGS. 1 and 4) of the nozzle are positioned such that they contact or almost contact the inside surface of the tube 13 whereby, when the nozzle is rotated relative to the tube to a position where the slot 223 is fully out of registry with the slot 14, the walls of the nozzle and the inner wall of the tube co-operate to form a seal and prevent the suction in the duct 22 being applied via the slot 14 to the throat of the two rollers.

The shaft 65 carries a pin 69 which co-operates with a guideway 70 formed in the bore 68 of the nozzle. The guideway is so curved that on axial movement of the shaft 65 the nozzle is turned in an anticlockwise direction as viewed from the button 60 to move the slot 223 gradually and increasingly out of registration with the slot 14 to eventually seal off suction to the throat.

Thus manual depression of the button 60 causes gradual stopping of the suction to the throat and release of the button causes, by a return spring 71, restarting of the suction.

It will be noted that the triangular shape of the slot 223 is such that the suction is first sealed off from the throat adjacent the delivery tube 56. Gradually the suction is sealed or closed off further toward the end of the throat remote from the tube 56 until eventually it is completely sealed off.

In operation, following a break in the yarn or some other stoppage of the spinning on the unit, a restarting programme is performed. The rollers 1 and 2 are continually connected to the drive motor (not shown) and hence do not stop after the stoppage or during the restarting programme.

The package is first stopped by lifting the package from the drive roller. Yarn is then unwound from the package to a sufficient length where it can be severed to a predetermined length for feeding back to the throat of the rollers. The yarn is then led back from the package avoiding the withdrawing rollers 55, which also rotate continuously, to the delivery tube 56. At this stage the button 60 is not depressed so that the suction through the slot 14 is maintained and this acts to draw the yarn end through the delivery tube 56 to the end of the slot 14 adjacent the tube 56. The button 60 is then gradually depressed so as to gradually close off the suction increasingly toward the opposite end of the slot 14. This causes the yarn end to be drawn from the tube 56 up to the opposite end of the slot 14. Finally the suction through the slot 14 is fully sealed off which allows the yarn to be drawn into the nozzle 44 of the feed duct 41 toward the duct 49 by the airstream developed by the duct 49. As the suction through the surface of the roller 1 is stopped, the yarn is allowed to pass into the feed duct 41 freely and thus the end is free to move to its full extent without any buckling or tangling of the intervening yarn portion. In this position the yarn lies in a straight path adjacent the throat and free from the influence of the suction.

During this time the fibre feed is halted by stopping the feed roller 35 by an automatic end break detector switch (not shown).

At this point, the button 60 is released allowing the suction to restart and to bring the straight yarn end portion under its influence so that the end portion is drawn still in its straight condition to lie in the throat. The predetermined length of the yarn is chosen such that the end, in the straight condition of the end portion, lies in the throat intermediate the ends of the perforated portion 3 and not beyond the end of the rollers.

Substantially simultaneously with the release of the button, the fibre feed is restarted by operation of the manual switch 59, at an exact timing to be found by experimentation, such that the fibres are fed onto the yarn end on the rollers to recommence the formation of twisted yarn. The yarn withdrawal is than restarted by returning the package to the drive roller and finally by reinserting the yarn into the nip of the withdrawal rollers.

In an alternative embodiment (not shown) the suction duct for drawing back the yarn from the guide tube 36 is not part of the fibre feed duct but is separate therefrom and has as its only or main function the withdrawal of the yarn end for piecing. The duct may be positioned on the opposite side of the throat from the fibre feed duct.

Alternatively or additionally to either embodiment, there may be provided an air injection nozzle (not shown) connected to or part of the guide tube 56 for injecting an airstream and thus drawing the yarn end portion into the position adjacent the throat. This may merely assist the effect of the suction duct 49 or it may act alone to place the yarn in the proper position for piecing.

In a further alternative arrangement, the suction through the surface is maintained continuously, and the yarn is introduced into a position adjacent the throat at a position which is sufficiently remote from the throat an/or in an airstream which is sufficiently strong such that the yarn end portion is free from the influence of the suction through the surface. That is, the yarn is free to extend in a straight line without being drawn into contact with the surfaces of the rollers. This position may be on the side of the rollers opposite the fibre feed duct. The yarn end portion may be brought under the influence of the suction by mechanical movement of the guide tube 56 by means (not shown) such that the tube is firstly moved out of its normal position during spinning to a piecing position and then returned to the normal position to restart spinning.

We claim:

1. A method of starting spinning an open-end spinning apparatus including at least one surface, fibre feed means for feeding fibres onto the surface at a yarn formation area, means for applying a suction through the surface at a yarn formation area, means for moving the surface past the yarn formation area to twist the fibres deposited thereon the form a yarn, means for withdrawing the yarn transversely to the direction of motion of the surface, and means for packaging the withdrawn yarn, the method comprising, taking the yarn end from the package and withdrawing it such that the end portion of the yarn extends to a predetermined length, placing the end portion of the surface at the yarn formation area, restarting the fibre feed means and restarting the withdrawal of the yarn from the yarn formation area, characterized in that the end portion is first moved to a position such that it lies adjacent the yarn formation area and in such a condition that it is free from the influence of the suction and then the end portion is brought under the influence of the suction such that it is drawn to lie on the yarn formation area.

2. A method according to claim 1, wherein the end portion is moved into the position by being entrained in an air stream.

3. A method according to claim 2, wherein the air stream is provided by a further suction means.

4. A method according to claim 2, for an apparatus including a yarn guide for controlling the yarn as it is withdrawn from the surface, wherein the air stream acts to draw the yarn end portion through the guide.

5. A method according to claim 1, wherein the suction through the surface is closed off while the end portion is in the position and then restarted to draw the end portion onto the yarn formation area.

6. A method according to claim 1, wherein the surface continues to move throughout the method.

7. A method according to claim 1, wherein the end portion of the yarn is of such a predetermined length that when the yarn is drawn to lie on the yarn formation area the end lies on the area.

8. A method according to claim 1, wherein the suction through the surface is gradually closed off from one end of the yarn formation area toward the other end so as to move the yarn end toward said other end.

9. A method according to claim 8, wherein, when the yarn end is moved by said suction to its full extent on the yarn formation surface, the suction is fully closed off and the yarn drawn into said position by a further suction duct.

10. A method of starting spinning an open-end spinning apparatus including at least one surface, fibre feed means for feeding fibres onto the surface at a yarn formation area, means for applying a suction through the surface at the yarn formation area, means for moving the surface past the yarn formation area to twist the fibres deposited thereon to form a yarn, means for withdrawing the yarn transversely to the direction of motion of the surface, and means for packaging the withdrawn yarn, the method comprising, taking the yarn end from the package and withdrawing it such that the end portion of the yarn extends to a predetermined length, placing the end portion on the surface at the yarn formation area, restarting the fibre feed means and restarting the withdrawal of the yarn from the yarn formation area, characterized in that, in order to place the end portion on the yarn formation area, the suction through the surface is gradually closed off from one end of the yarn formation area toward the opposite end so as to draw the yarn end toward said opposite end.

11. A method according to claim 10, for an apparatus including a yarn guide for controlling the yarn as it is withdrawn from the surface, wherein the yarn end is drawn through the yarn guide by the suction through the surface prior to closing off the suction.

12. Apparatus for open-end spinning yarn comprising at least one surface, fibre feed means for feeding fibres onto the surface at a yarn formation area, means for applying a suction through the surface at the yarn formation area drive means for moving the surface past the yarn formation area to twist the fibres deposited thereon to form a yarn, means for withdrawing the yarn transversely to the direction of motion of the surface and means for packaging the withdrawn yarn, characterized in that for starting spinning on the apparatus there are provided means for moving an end portion of yarn withdrawn from the package to a position adjacent the yarn formation area, the end moving means and suction means being so arranged that in said position the end portion is free from the influence of the suction means, and means for bringing the end portion under the influence of the suction means such that it is drawn to lie on the yarn formation area.

13. Apparatus according to claim 12, wherein said end moving means comprises means for developing an air stream.

14. Apparatus according to claim 13, wherein said end moving means comprises a suction duct adjacent the surface.

15. Apparatus according to claim 12, including means for temporarily stopping and then restarting the suction through the surface.

16. Apparatus according to claim 15, wherein the stopping means is operable such that the suction is stopped while the end portion is in the position and then restarted to draw the end portion into the yarn formation area.

17. Apparatus according to claim 15, wherein the suction means includes a member defining a slot adjacent the yarn formation area and a nozzle cooperating with the slot to communicate suction to the area, and wherein the stopping means is arranged to move the nozzle relative to the slot to form a seal with the member.

18. Apparatus according to claim 15, wherein the stopping means is spring biased to a position in which the suction means applies suction to the surface.

19. Apparatus according to claim 12, wherein the means for moving the surface is arranged to move the surface continuously during spinning and starting spinning.

20. Apparatus according to claim 12, wherein the end moving means includes means for gradually closing off the suction through the surface from one end of the yarn formation area toward the opposite end whereby to move the yarn end toward said opposite end.

21. In an apparatus for open end spinning yarn, comprising at least one surface, fibre feed means for feeding fibres onto the surface at a yarn formation area, means for defining an elongate zone on the surface at the yarn formation area said zone having two opposed ends, means for applying a suction through the surface at the zone, means for moving the surface past the yarn formation area to twist the fibres deposited thereon to form a yarn, means for withdrawing the yarn transversely to the direction of motion of the surface and means for packaging the withdrawn yarn, the improvement wherein there is provided means for gradually closing off said zone from one end thereof toward the opposite end thereof whereby to move an end of said yarn when placed adjacent said one end toward said opposite end.

* * * * *